US009229375B2

(12) United States Patent
Kubo et al.

(10) Patent No.: US 9,229,375 B2
(45) Date of Patent: Jan. 5, 2016

(54) INTERMEDIATE TRANSFER BELT AND METHOD OF PREPARING THE SAME, AND IMAGE FORMING APPARATUS

(71) Applicants: Hidetaka Kubo, Kanagawa (JP); Jun Aoto, Kanagawa (JP)

(72) Inventors: Hidetaka Kubo, Kanagawa (JP); Jun Aoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/149,989

(22) Filed: Jan. 8, 2014

(65) Prior Publication Data

US 2014/0248070 A1 Sep. 4, 2014

(30) Foreign Application Priority Data

Mar. 1, 2013 (JP) ..... 2013-040771

(51) Int. Cl.
*G03G 15/01* (2006.01)
*G03G 15/16* (2006.01)

(52) U.S. Cl.
CPC ..... *G03G 15/162* (2013.01); *G03G 15/1685* (2013.01)

(58) Field of Classification Search
CPC ..... G03G 15/162; G03G 15/1605; G03G 15/1685; G03G 2215/1623; G03G 13/16; B29C 41/26
USPC ..... 399/302, 303, 308, 312; 430/125.32
See application file for complete search history.

(56) References Cited

U.S. PATENT DOCUMENTS

| | | | | |
|---|---|---|---|---|
| 2005/0070684 | A1* | 3/2005 | Gallucci et al. | 528/170 |
| 2007/0268350 | A1* | 11/2007 | Ageishi | 347/104 |
| 2009/0231518 | A1* | 9/2009 | Sekiguchi et al. | 349/96 |
| 2009/0246392 | A1* | 10/2009 | Miyamoto | 427/385.5 |
| 2011/0177238 | A1 | 7/2011 | Aoto et al. | |
| 2013/0230724 | A1* | 9/2013 | Miyamoto et al. | 428/411.1 |
| 2014/0248069 | A1* | 9/2014 | Kubo et al. | 399/302 |

FOREIGN PATENT DOCUMENTS

| | | | |
|---|---|---|---|
| JP | 2002275281 A | * | 9/2002 |
| JP | 2005-163007 | | 6/2005 |
| JP | 2005215028 A | * | 8/2005 |
| JP | 2007-114754 | | 5/2007 |

* cited by examiner

*Primary Examiner* — Robert Beatty
(74) *Attorney, Agent, or Firm* — Cooper & Dunham LLP

(57) ABSTRACT

An intermediate transfer belt includes a polyimide resin or a polyamideimide resin including only γ-butyrolactone of from 5 to 5,000 ppm as a residual solvent.

6 Claims, 3 Drawing Sheets

INTERMEDIATE TRANSFER BELT AND METHOD OF PREPARING THE SAME, AND IMAGE FORMING APPARATUS

CROSS-REFERENCE TO RELATED APPLICATIONS

This patent application is based on and claims priority pursuant to 35 U.S.C. §119 to Japanese Patent Application No. 2013-040771, filed on Mar. 1, 2013, in the Japan Patent Office, the entire disclosure of which is hereby incorporated by reference herein.

BACKGROUND

1. Technical Field

The present invention relates to an intermediate transfer belt equipped in image forming apparatuses such as copiers and printers and a method of preparing the same, and to an image forming apparatus.

2. Description of the Related Art

In the conventional art, a belt, especially a seamless belt, has been used for various purpose, as a member in an electrophotographic image forming apparatus. In recent years, an intermediate transfer belt system has been used in a full color image forming apparatus, where the intermediate transfer belt system includes superimposing developed images of four colors, yellow, magenta, cyan, and black temporarily on an intermediate transfer member, and collectively transferring the superimposed images onto a transfer medium, such as paper.

As for the aforementioned intermediate transfer belt, a system using developing units of four respective colors to one photoreceptor has been used, but this system has a problem that a printing speed thereof is slow. Accordingly, to achieve high speed printing, a quarto-tandem system has been used, where the tandem system includes providing photoreceptors of four respective colors, and an image of each color is continuously transferred to paper.

In this system, however, it is very difficult to accurately position images of colors to be superimposed, as the paper is affected by the fluctuations of the environment, which causing displacement of the colors in the image. Accordingly, currently, an intermediate transfer belt system has been mainly adapted for the quarto-tandem system.

Under the circumstances as mentioned above, the higher requirements for properties (high speed transferring, and accuracy for positioning) of a intermediate transfer belt have been demanded than before, and therefore it is necessary for an intermediate transfer belt to satisfy these requirements. Especially for the accuracy for positioning, it has been required to inhibit variations caused by deformation of an intermediate transfer belt itself, such as stretching, after continuous use thereof. Moreover, an intermediate transfer belt is desired to have flame resistance as it is provided over a wide region of a device, and high voltage is applied thereto for transferring. To satisfy these demands, a polyimide resin that is a highly elastic and highly heat resistant resin, has been mainly used as a material of an intermediate transfer belt.

When the intermediate transfer belt is used in an image forming apparatus for long periods, the edge of the belt cracks or the belt breaks when curved by a drive roller. Therefore, the running belt does not have sufficient durability.

Japanese Patent No. JP-4840038-B2 (Japanese published unexamined application No. 2007-14754-A) discloses a method of specifying a volatile material in an intermediate transfer belt to be 10 to 100,000 ppm to improve durability and transferability thereof. This relates to improvement of durability of a surface layer, and is different from the present invention in technological thought.

Japanese Patent No. JP-4356508-B2 (Japanese published unexamined application No. 2005-163007-A) discloses an intermediate transfer belt using a polyamic acid prepared with a mixed solvent including γ-butyrolactone and N-methyl-2-pyrrolidone. However, N-methyl-2-pyrrolidone is likely to remain as a residual solvent and resistivity is likely to change at low (high) temperature and low (high) humidity, resulting in image density of the resultant images is likely to change. N-methyl-2-pyrrolidone has high hygroscopicity and the belt is likely to change in sizes.

The polyimide is typically a very expensive material, and polyamideimide is widely used instead. The polyamideimide has higher hygroscopicity than the polyimide, and is not only poor in size stability but also low in flexibility as a resin. Therefore, the polyamideimide is low in durability. i.e., likely to crack and cut.

Because of these reasons, a need exists for an intermediate transfer belt having high durability, producing high quality images without change of image density even when the environment drastically changes.

SUMMARY

Accordingly, one object of the present invention is to provide an intermediate transfer belt having high durability, producing high quality images without change of image density even when the environment drastically changes.

Another object of the present invention is to provide a method of preparing the intermediate transfer belt.

A further object of the present invention is to provide an image forming apparatus using the intermediate transfer belt.

These objects and other objects of the present invention, either individually or collectively, have been satisfied by the discovery of an intermediate transfer belt including a polyimide resin or a polyamideimide resin including only γ-butyrolactone of from 5 to 5,000 ppm as a residual solvent.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

The present invention provides an intermediate transfer belt having high durability, producing high quality images without change of image density even when the environment drastically changes.

First Embodiment

Figure 1:
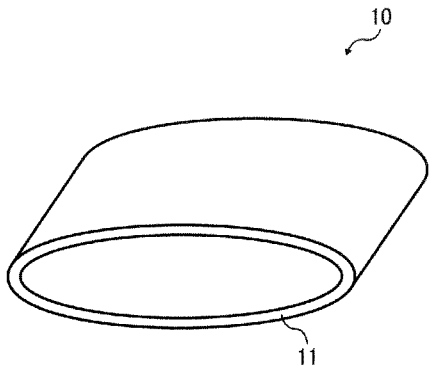
FIG. 1 is a schematic perspective view illustrating an embodiment of the intermediate transfer belt of the present invention.

FIG. 1 is a schematic perspective view illustrating an embodiment of the intermediate transfer belt of the present invention.

The intermediate transfer belt of the embodiment is a seamless (endless) belt used in electrophotographic image forming apparatuses. The electrophotographic image forming apparatus including the intermediate transfer belt of the embodiment is a full-color image forming apparatus including an image developer developing a latent image formed on an image bearer with a toner to form a toner image, an intermediate transfer belt the toner image is first transferred onto, and a transferer secondly transferring the toner image onto a recording medium from the intermediate transfer belt. Plural color toner images formed on an image bearer such as a photoreceptor drum are sequentially transferred onto the intermediate transfer belt while overlapped (first transfer), and the overlapped toner images are secondly transferred onto a recording medium. In the electrophotographic image forming apparatuses, seamless belts are used for some members. A seamless intermediate transfer belt is one of important members, satisfying high electrical properties. The intermediate transfer belt is preferably an endless seamless belt for high-speed printing.

The intermediate transfer belt 10 of the present invention is a polyimide resin 11. The polyimide resin 11 includes only γ-butyrolactone of from 5 to 5,000 ppm as a residual solvent. Preferably from 10 to 100 ppm. When less than 5 ppm, the belt has low durability, i.e., is likely to crack and cut. When not less than 5,000 ppm, the image quality does not stabilize when the temperature and humidity change.

The polyimide resin 11 preferably has an average thickness of from 40 to 120 μm, and more preferably from 50 to 100 μm. When less than 40 μm, the edge of the belt is likely to cut when driven. When greater than 120 μm, the belt is likely to crack when driven.

The average thickness is an average value of the values of the thickness measured at arbitrarily selected 10 spots. The thickness can be measured by typical needle-indicating or eddy-current thickness meters, for example, by an electric micrometer manufactured by Anritsu Corporation.

The embodiment has a single-layered structure, and may have a double or more multilayered structure. The same resin is preferably used in each of the layers in terms of adhesiveness therebetween.

The polyimide resin includes a filler (or an additive) regulating the electrical resistance, i.e., an electrical resistance regulator. Examples of the electrical resistance regulator include metal oxide, carbon black, an ion conductive agent, and an electric conductive polymer material. Details are explained later.

Next, the polyimide resin used in this embodiment is explained.

The polyimide resin is not particularly limited, but aromatic polyimide is preferably used, The aromatic polyimide is obtained through a polyamic acid (polyimide precursor) produced from a reaction between aromatic polycarboxylic acid anhydrides (or their derivatives) and aromatic diamines.

The aromatic polyimide is insoluble in solvents because of its rigid main chain structure, and does not melt. First, aromatic polycarboxylic acid anhydrides and aromatic diamines are reacted with each other to synthesize a polyimide precursor (polyamic acid). The polyamic acid is heated or chemically dehydrated to obtain cyclized (imidized) polyimide. A reaction example of obtaining the aromatic polyimide is shown in the following formula (1).

(1)

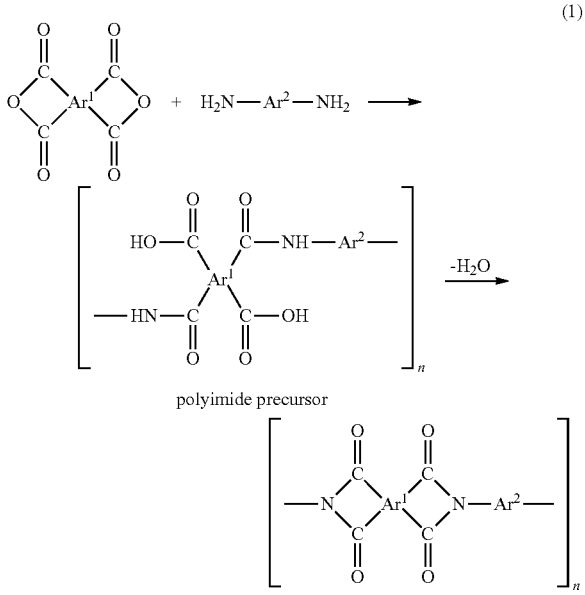

wherein $Ar^1$ is a tetravalent aromatic residue containing at least one 6-membered carbon ring; and Ar is a divalent aromatic residue containing at least one 6-membered carbon ring.

The aromatic polyimide is obtained by subjecting almost same moles of the following aromatic polycarboxylic acid anhydrides and aromatic diamines to polymerization reaction in an organic polar solvent to prepare a polyimide precursor (polyamic acid), and then the polyamic acid is dehydrated to obtain cyclized (imidized) polyimide.

Methods of preparing the polyamic acid are specifically explained.

Specific examples of the organic polar solvent used in the polymerization reaction to prepare the polyamic acid include, but are not limited to, a sulfoxide-based solvent such as dimethylsulfoxide, and diethyl sulfoxide; a formamide-based solvent such as N,N-dimethylformamide, and N,N-diethylformamide; an acetoamide-based solvent such as N,N-dimethylacetamide, and N,N-diethylacetoamide; a pyrrolidone-based solvent such as N-methyl-2-pyrrolidone, and N-vinyl-2-pyrrolidone; and a phenol-based solvent such as phenol, o-, m-, or p-cresol, xylenol, halogenated phenol, and catechol; an ether-based solvent such as tetrahydrofuran, dioxane, and dioxolane; an alcohol-based solvent such as methanol, ethanol, and butanol; a cellosolve-based solvent such as butyl cellosolve; hexamethylphosphoramide; and γ-butyrolactone.

Among these solvents, γ-butyrolactone is preferably used alone to dissolve the polyamic acid. A mixed solvent is likely to evaporate when the polyamic acid is imidized, and it is difficult to control a remaining amount of γ-butyrolactone.

As for solvents besides γ-butyrolactone, a residual solvent changes resistivity of the belt when the environment changes after a polyimide precursor is heated to be imidized, and the image density is likely to change. To solve these problems, the residual solvent needs to be nil, which further needs heating the belt for a long time at a high temperature of from 350 to 450° C. However, the belt is fragile and likely to break.

When γ-butyrolactone is used alone and remains in the belt in an amount of from 5 to 5,000 ppm, the problem can be avoided. When less than 5 ppm, the belt is likely to break. When greater than 5.000 ppm, the image density is likely to change when the environment changes.

This may be because γ-butyrolactone forms a small hydrogen bond with an unreacted group when the polyimide is imidized, and the belt has suitable flexibility.

Solubility of the acid anhydrides and diamine is higher in N-methyl-2-pyrrolidone than γ-butyrolactone, and they may be mixed for high solidification. However, only the γ-butyrolactone evaporates in imidization and is difficult to remain in the belt. Further, it is not preferable that they are mixed in terms of stability of the image quality and durability of the belt.

An example of preparing the polyimide precursor, first, one or more diamine is dissolved in the organic solvent, or dispersed therein to form a slurry in an atmosphere of inactive gas such as argon or nitrogen. To the resultant solution, an aromatic polycarboxylic anhydride (or a derivative thereof) is added (which may be in the state of a solid, a solution being dissolved in an organic solvent, or a slurry) to thereby proceed to a ring-opening polyaddition reaction with generation of heat. As a result, the solution suddenly increases its viscosity, to thereby prepare a high-molecular-weight polyamic acid solution. The reaction temperature is preferably from −20 to 100° C., and more preferably in the range of −20 to 60° C. The reaction time is about from 30 min to 12 hrs.

The example described above is one example. Conversely to the order of addition above, first, aromatic tetracarboxylic dianhydride or a derivative thereof is dissolved or dispersed in an organic solvent in advance, and to the resultant solution, the aromatic diamine (diamine) may be added. The diamine may be added in the state of a solid, or a solution prepared by dissolving the aromatic diamine compound in an organic solvent, or a slurry. Namely, the order for adding the aromatic tetracarboxylic dianhydride and the diamine is not limited. Further, aromatic tetracarboxylic dianhydride and the diamine compound may be simultaneously added to the organic polar solvent to proceed to a reaction.

Specific examples of the aromatic polycarboxylic anhydride include, but are not limited to, pyromellitic acid dianhydride, 4,4'-oxydiphthalic dianhydride, ethylene tetracarboxylic dianhydride, cyclopentane tetracarboxylic dianhydride, 3,3',4,4'-benzophenonetetracarboxylic dianhydride, 2,2',3,3'-benzophenonetetracarboxylic dianhydride, 3,3',4,4'-biphenyltetracarboxylic dianhydride, 2,2',3,3'-biphenyltetracarboxylic dianhydride, 2,2-bis(2,3-dicarboxyphenyl)propane dianhydride, bis(3,4-dicarboxyphenyl) ether dianhydride, bis(3,4-dicarboxyphenyl)sulfone dianhydride, 1,1-bis(2,3-dicarboxyphenyl)ethane dianhydride, bis(2,3-dicarboxyphenyl)methane dianhydride, bis(3,4-dicarboxyphenyl)methane dianhydride, 2,2-bis(3,4-dicarboxylphenyl)-1,1,1,3,3,3-hexafluoropropane dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 1,2,3,4-benzenetetracarboxylic dianhydride, 3,4,9,10-perylenetetracarboxylic dianhydride, 2,3,6,7-anthracenetetracarboxylic dianhydride, and 1,2,7,8-phenanthrenetetracarboxylic dianhydride. These can be used alone or in combination.

Specific examples of the aromatic diamine compound include, but are not limited to, 4,4'-diaminodiphenylether, 3,3'-diaminodiphenylether, 3,4'-diaminodiphenylether, m-phenylene diamine, o-phenylene diamine, p-phenylene diamine, m-aminobenzyl amine, p-aminobenzyl amine, bis(3-aminophenyl)sulfide, (3-aminophenyl)(4-aminophenyl) sulfide, bis(4-aminophenyl)sulfide, (3-aminophenyl)(4-aminophenyl)sulfoxide, bis(3-aminophenyl)sulfone, (3-aminophenyl)(4-aminophenyl)sulfone, bis(4-aminophenyl)sulfone, 3,3'-diaminobenzophenone, 3,4'-diaminobenzophenone, 4,4'-diaminobenzophenone, 3,3'-diaminodiphenyl methane, 3,4'-diaminodiphenyl methane, 4,4'-diaminodiphenyl methane, bis[4-(3-aminophenoxy)phenyl] methane, bis[4-(4-aminophenoxy)phenyl]methane, 1,1-bis[4-(3-aminophenoxy)phenyl]ethane, 1,1-bis[4-(4-aminophenoxy)phenyl]-ethane, 1,2-bis[4-(3-aminophenoxy)phenyl]ethane, 1,2-bis[4-(4-aminophenoxy) phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy) phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,3-bis(4-aminophenoxy) benzene, 1,4-bis(3-aminophenoxy)benzene, 1,4-bis(4-aminophenoxy)benzene, 4,4'-bis(3-aminophenoxy) biphenyl, 4,4'-bis(4-aminophenoxy)biphenyl, bis[4-(3-aminophenoxy)phenyl]ketone, bis[4-(4-aminophenoxy) phenyl]ketone, bis[4-(3-aminophenoxy)phenyl]sulfide, bis [4-(4-aminophenoxy)phenyl]sulfide, bis[4-(3-aminophenoxy)phenyl]sulfoxide, bis[4-(4-aminophenoxy) phenyl]sulfoxide, bis[4-(3-aminophenoxy)phenyl]sulfone, bis[4-(4-aminophenoxy)phenyl]sulfone, bis[4-(3-aminophenoxy)phenyl]ether, bis[4-(4-aminophenoxy)phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy) benzoyl]diphenyl ether, 4,4'-bis[4-(4-amino-α,α-dimethylbenzyl)phenoxy]benzophenone, 4,4'-bis[4-(4-amino-α,α-dimethylbenzyl)phenoxy]diphenylsulfone, bis [4-({4-(4-aminophenoxy)phenoxy}phenyl]sulfone, 1,4-bis [4-(4-aminophenoxy)phenoxy]-α,α-dimethylbenzyl] benzene, and 1,3-bis[4-(4-aminophenoxy)-α,α-dimethylbenzyl]benzene. These can be used alone or in combination.

In the manner as described above, an equimolar aromatic polycarboxylic anhydride or a derivative thereof, and an equimolar aromatic diamine compound are subjected to a polymerization reaction in an organic polar solvent, to thereby prepare a polyamic acid (polyimide precursor) solution in the state that polyamic acid is uniformly dissolved in the organic polar solvent.

In the polyamic acid solution, fillers such as an electrical resistance regulator, a dispersion auxiliary, a reinforcing agent, a lubricant, a heat-transfer agent and an antioxidant are mixed when necessary to prepare a coating liquid. After the coating liquid is coated on a substrate (forming mold) as mentioned later, the liquid is heated such that the polyamic acid which is a polyimide precursor is imidized to polyimide.

The polyamic acid can be imidized by a (1) heating method, or a (2) chemical method. The (1) heating method is a method for transforming (imidizing) the polyamic acid to polyimide by heating the polyamic acid to 200 to 350° C., and is a simple and practical method for attaining polyimide (a polyimide resin). The (2) chemical method is a method in which after reacting the polyamic acid with a cyclodehydration reagent (e.g., a mixture of carboxylic anhydride and tertiary amine), the resultant is heated to thereby completely imidize the polyamide acid, and a complicated and costly method compared to the (1) heating method. From this reason, generally, the (1) heating method is commonly used.

The other components are appropriately selected depending on the intended purpose without any limitation, and examples thereof include an electrical resistance regulator, an ion conductive agent, a dispersion auxiliary, a reinforcing agent, a lubricant, a heat-transfer agent and an antioxidant.

Examples of the electrical resistance regulator include metal oxide, carbon black, an ion conductive agent, and an electric conductive polymer material.

Examples of the metal oxide include zinc oxide, tin oxide, titanium oxide, zirconium oxide, aluminum oxide, and silicon oxide. Other examples thereof include products obtained by subjecting the above metal oxide to a surface treatment for improving dispersibility thereof. Among these, carbon black is preferably used because it is easy to disperse and difficult to deteriorate in strength.

Examples of the carbon black include ketjen black, furnace black, acetylene black, thermal black and gas black.

Examples of the ion conductive agent include a tetra alkyl ammonium salt, a trialkylbenzyl ammonium salt, an alkylsulfonic acid salt, an alkylbenzenesulfonic acid salt, alkyl sulfate, glycerin fatty acid ester, sorbitan fatty acid ester, polyoxyethylenealkylamine, ester of polyoxyethylene aliphatic alcohol, alkyl betaine, and lithium perchlorate.

Examples of electric conductive polymer material include polyaniline, polythiophene, and polypyrrole. These can be used alone or in combination.

The electrical resistance regulators in this embodiment are not limited to the above. A coating liquid including at least a resin for preparing a seamless belt of this embodiment may further include an additive such as a dispersion auxiliary, a reinforcing agent, a lubricant, a heat-transfer agent and an antioxidant.

To uniformly disperse carbon black in the intermediate transfer belt, it is preferable that carbon black is uniformly dispersed in γ-butyrolactone first, and that the mixture is fully mixed with the polyimide precursor.

Any dispersers such as ball mills, roll mills, beads mills and sand mills can be used in the present invention.

When a seamless belt is used as the intermediate transfer belt, carbon black is included in its layers such that the electric resistance thereof is $1\times10\Omega/\square$ to $1\times10^{15}\Omega/\square$ in the surface resistance when 500 V is applied thereto, and $1\times10^{8}$ Ω·cm to $1\times10^{14}$ Ω·cm in the volume resistance when 100 V is applied thereto. However, in terms of mechanical strength, carbon black is included in the layers in such an amount as they are not fragile and easily cracked. Namely, a coating liquid including the resin (a polyimide resin precursor or a polyamideimide resin precursor) and the electrical resistance regulator in suitable amounts, respectively is preferably used to prepare a seamless belt having a good balance between electrical properties (surface resistivity and volume resistivity) and mechanical strength.

When the electrical resistance is the carbon black, the content thereof is preferably from 10 to 25% by weight, and more preferably from 15 to 20% by weight. When the electrical resistance is the metal oxide, the content thereof is preferably from 1 to 50% by weight, more preferably from 10 to 30% by weight. When the content is too low, the resistance is difficult to have uniformity and largely varies relative to arbitrary potentials. When too much, the intermediate transfer belt deteriorates in mechanical strength for practical use.

A method of preparing the intermediate transfer belt of the embodiment includes a process of forming a film on the outer surface of a cylindrical metal mold by coating a coating liquid including the polyimide precursor and at least γ-butyrolactone as an organic solvent thereon; a process of heating the film from the inside of the cylindrical metal mold to transform the polyimide precursor to a polyimide resin and having only the γ-butyrolactone remain in the polyimide resin in an amount of from 5 to 5,000 ppm; and a process of demolding the polyimide resin from the cylindrical metal mold.

A coating liquid including the polyimide precursor is coated on a cylindrical mold, such as a cylindrical metal mold, by a liquid applicator such as a nozzle and a dispenser, while slowly rotating the cylindrical mold, so as to uniformly coat the outer surface of the cylindrical mold with the coating liquid, to thereby perform flow casting (forming a coating film). Thereafter, the rotational speed is increased to a predetermined speed. Once the rotational speed reaches the predetermined speed, the rotational speed is maintained constant, and the rotation is continued for a predetermined period. Then, the temperature is gradually elevated while rotating the cylindrical mold, to thereby evaporate the solvent in the coating film at the temperature of 80 to 150° C. It is preferred that the vapor (e.g., the evaporated solvent) in the atmosphere be efficiently circulated and removed. Once a self-supporting film is formed, the mold with the film is placed in a heating furnace (baking furnace) capable of performing a high temperature treatment. Then, the temperature of the furnace is increased stepwise, and eventually a high temperature heat treatment (baking) is performed at the temperature ranging from about 200 to about 350° C., to thereby sufficiently imidize the polyimide precursor.

The intermediate transfer belt is preferably heated from the inside of the metal mold so as to include the γ-butyrolactone in an amount of from 5 to 5.000 ppm. Any heaters may be used, and specifically a halogen heater and an IH heater can be used. Coating the outer surface of the metal mold and heating from the inside thereof effectively control the intermediate transfer belt to include the γ-butyrolactone in an amount of from 5 to 5.000 ppm.

The method of preparing the intermediate transfer belt is not limited thereto, and appropriately selected depending on the intended purpose. Examples thereof include a method containing: preparing a coating liquid in which the aforementioned other components such as the electrical resistance-controlling agent are optionally dispersed in the polyimide precursor solution (polyamic acid solution); applying the coating liquid onto a substrate; and transforming (imdizing) polyamic acid, which is polyimide precursor, into polyimide, as well as forming the coating liquid into a layer by a processing, such as heating.

The substrate is not particularly limited and appropriately selected depending on the intended purpose, and examples thereof include a cylindrical metal mold. The polyimide precursor solution is coated on the outer or inner surface of the metal mold. The outer surface is preferably coated because it is easy to control the intermediate transfer belt to include the γ-butyrolactone in an amount of from 5 to 5,000 ppm.

As a method of measuring an amount of the γ-butyrolactone, a piece cut from tan arbitrary part of the intermediate transfer belt is analyzed by heat extraction gas chromatograph mass spectrometry (GC-MS). A marketed GC-MS device such as GCMS-QP2010 from Shimadzu Corp. can be used.

Second Embodiment

A second embodiment of the intermediate transfer belt of the present invention is explained. The intermediate transfer belt of the embodiment is a polyamideimide resin. The second embodiment is different from the first embodiment in a material.

The intermediate transfer belt of the present invention is installed in the image forming apparatus of the first embodiment, and the intermediate transfer belt is a polyamideimide resin. The polyamideimide resin includes only γ-butyrolactone of from 5 to 5,000 ppm as a residual solvent. Preferably from 10 to 100 ppm. When less than 5 ppm, the belt has low durability, i.e., is likely to crack and cut. When not less than 5,000 ppm, the image quality does not stabilize when the temperature and humidity change.

The polyamideimide resin preferably has an average thickness of from 40 to 120 μm, and more preferably from 50 to 100 μm. When less than 40 μm, the edge of the belt is likely to cut when driven. When greater than 120 μm, the belt is likely to crack when driven.

The average thickness is an average value of the values of the thickness measured at arbitrarily selected 10 spots. The thickness can be measured by typical needle-indicating or eddy-current thickness meters, for example, by an electric micrometer manufactured by Anritsu Corporation.

The polyamideimide resin includes a filler (or an additive) regulating the electrical resistance, i.e., an electrical resistance regulator. Examples of the electrical resistance regulator include metal oxide, carbon black, an ion conductive agent, and an electric conductive polymer material. These are the same as the other components of the first embodiment.

The polyamideimide is a resin having a rigid imide group and a flexibility-imparting amide group in its molecular skeleton. Known polyamideimide can be used in this embodiment.

Typically, the following methods of synthesizing polyamideimide resins are known.

(a) Japanese published examined application No. JP-S42-15637-B discloses an acid chloride method of reacting a derivative halide of tricarboxylic acid having an acid anhydride group, typified by a chloride compound of the derivative, and diamine in a solvent.

(b) Japanese published examined application No. JP-S44-19274-B discloses an isocyanate method of reacting a trivalent including an acid anhydride group and a carboxylic acid having, and an aromatic isocyanate in a solvent.

(a) Acid Chloride Method

Specific examples of the derivative halide of tricarboxylic acid having an acid anhydride group include compounds having the following formulae (2) and (3):

(2)

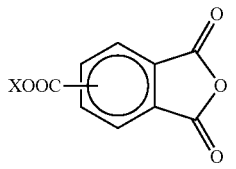

(3)

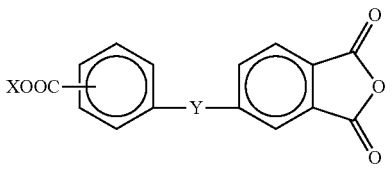

wherein X represents a halogen atom; and Y represents $CH_2$—, —CO—, —$SO_2$— or —O—.

In the above formulae, the halogen atom is preferably chloride. Specific examples of the derivative include, but are not limited to, acid chlorides of polycarboxylic acid such as terephthalic acid, isophthalic acid, 4,4'-biphenyldicarboxylic acid, 4,4'-biphenyletherdicarboxylic acid, 4,4'-biphenylsulfonedicarboxylic acid, 4,4'-benzophenonedicarboxylic acid, pyromellitic acid, trimellitic acid, 3,3'-4,4'-benzophenonetetracarboxylic acid, 3,3'-4,4'-biphenylsulfonetetracarboxylic acid, 3,3'-4,4'-biphenyltetracarboxylic acid, adipic acid, sebacic acid, maleic acid, fumaric acid, dimeric acid, stilbene dicarboxylic acid, 1,4-cyclohexanedicarboxylic acid, and 1,4-cyclohexanedicarboxylic acid.

Specific examples of the diamine include, but are not limited to, aromatic diamines, aliphatic diamines and alicyclic diamines. The aromatic diamines are preferably used.

Specific examples of the aromatic diamines include, but are not limited to, m-phenylene diamine, p-phenylene diamine, oxy dianiline, methylene diamine, hexafluoroisopropylidene diamine, diamino-m-xylilene, diamino-p-xylilene, 1,4-naphthalene diamine, 1,5-naphthalene diamine, 2,6-naphthalene diamine, 2,7-naphthalene diamine, 2,2'-bis-(4-aminophenyl)propane, 2,2'-bis-(4-aminophenyl) hexafluoropropane, 4,4'-diaminodiphenylsulfone, 4,4'-diaminodiphenylether, 3,3'-diaminodiphenylsulfone, 3,3'-diaminodiphenylether, 3,4'-diaminobiphenyl, 4,4'-diaminobenzophenone, 3,4'-diaminodiphenylether, isopropylidene dianiline, 3,3'-diaminobenzophenone, o-tolidine, 2,4-trilenediamine, 1,3-bis-(3-aminophenoxy)benzene, 1,4-bis(3-aminophenoxy)benzene, 1,3-bis-(4-aminophenoxy)benzene, 2,2-bis[4-(4-aminophenoxy)phenyl]propane, bis[4-(4-aminophenoxy)phenyl]sulfone, bis[4-(3-aminophenoxy)phenyl]sulfone, 4,4'-bis-(4-aminophenoxy)biphenyl, 2,2-bis[4-(4-aminophenoxy)phenyl]hexafluoropropane, 4,4'-diaminodiphenylsulfide, and 3,3'-diaminodiphenylsulfide, Silicone-modified polyamideimide can be obtained when siloxane compounds having an amino group at both ends as diamine are used. Specific examples of the siloxane compounds having an amino group at both ends as diamine include 1,3-bis(3-aminopropyl)-1,1,3,3-tetramethyldisiloxane, α,ω-bis-(3-aminopropyl)polydimethylsiloxane, 1,3-bis (3-aminophenoxymethyl)-1,1,3,3-tetramethyldisloxane, α,ω-bis-(3-aminophenoxymethyl)polydimethylsiloxane, 1,3-bis(2-(3-aminophenoxy)ethyl)-1,1,3,3-tetramethyldisloxane, α,ω-bis-(2-(3-aminophenoxy)ethyl))polydimethylsiloxane, 1,3-bis(3-(3-aminophenoxy)propyl)-1,1,3,3-tetramethyldisloxane, and α,ω-bis-(3-(3-aminophenoxy) propyl)polydimethylsiloxane.

To obtain polyamideimide in the embodiment by the acid chloride method, as the polyimide resin is prepared, a derivative halide of tricarboxylic acid having an acid anhydride group and diamine are dissolved in an organic polar solvent, and reacted therein at a low temperature of form 0 to 30° C. to prepare a polyamideimide precursor (polyamide-amic acid). Specific examples of the organic polar solvent include, but are not limited to, a sulfoxide-based solvent such as dimethylsulfoxide, and diethyl sulfoxide; a formamide-based solvent such as N,N-dimethylformamide, and N,N-diethylformamide; an acetoamide-based solvent such as N,N-dimethylacetamide, and N,N-diethylacetoamide; a pyrrolidone-based solvent such as N-methyl-2-pyrrolidone, and N-vinyl-2-pyrrolidone; and a phenol-based solvent such as phenol, o-, m-, or p-cresol, xylenol, halogenated phenol, and catechol; an ether-based solvent such as tetrahydrofuran, dioxane, and dioxolane; an alcohol-based solvent such as methanol, ethanol, and butanol; a cellosolve-based solvent such as butyl cellosolve; hexamethylphosphoramide; and γ-butyrolactone. Among these, γ-butyrolactone is preferably used alone, but may be mixed with other solvents when necessary.

The thus obtained polyamide precursor solution is coated to a substrate (or a mold), and the coated liquid is then subjected to a treatment such as heating. Thus, the polyamide precursor is transformed to polyamideimide (i.e., imidization).

Examples of the amideimidization include a method of inducing dehydration ring-closing reaction by heating in the same manner as in the polyimide, and a method of chemically ring closing using a dehydrating/ring-closing catalyst. When the dehydration ring-closing reaction is performed by heating, the reaction temperature is preferably 150° C. to 400° C., and more preferably 180° C. to 350° C. The heat treatment time is preferably 30 seconds to 10 hours, and more preferably 5 minutes to 5 hours. When the dehydrating/ring-closing catalyst is used, the reaction temperature is preferably 0° C. to 180° C., more preferably 10° C. to 80° C. The reaction time is preferably several tens minutes to several days, more preferably 2 hours to 12 hours. Examples of the dehydrating/ring-closing catalyst include acid anhydrides such as acetic acid, propionic acid, butyric acid, and benzoic acid.

(b) Isocyanate Method

Examples of the trivalent carboxylic acid compound having an acid anhydride group and a carboxylate group (derivative of the trivalent carboxylic acid compound having an acid anhydride group) in the isocyanate method include compounds represented by the following formula (4) or (5):

(4)

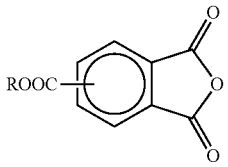

wherein R denotes a hydrogen atom, an alkyl or phenyl group having 1 to 10 carbon atoms.

(5)

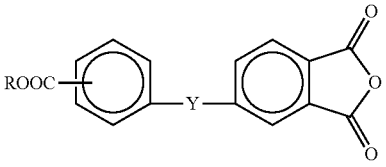

wherein R denotes a hydrogen atom, an alkyl or phenyl group having 1 to 10 carbon atoms; Y denotes a single bond, —$CH_2$—, —CO—, —$SO_2$— or —O—.

Any derivatives represented by the formula (4) or (5) can be used, and trimellitic anhydride is typically used. The derivatives of the trivalent carboxylic acid compound having an acid anhydride group may be used alone or in combination depending on the intended purpose.

Examples of aromatic polyisocyanate used to synthesize the polyamideimide of the present invention include 4,4'-diphenylmethane diisocyanate, tolylene diisocyanate, xylene diisocyanate, 4,4'-diphenyl ether diisocyanate, 4,4'-[2,2-bis(4-phenoxyphenyl)propane]diisocyanate, biphenyl-4,4'-diisocyanate, biphenyl-3,3'-diisocyanate, biphenyl-3,4'-diisocyanate, 3,3'-dimethylbiphenyl-4,4'-diisocyanate, 2,2'-dimethylbiphenyl-4,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate. These aromatic polyisocyanates may be used alone or in combination. When necessary, aliphatic, alicyclic isocyanates such as hexamethylene diisocyanate, 2,2,4-trimethylhexamethylene diisocyanate, isophorone diisocyanate, 4,4'-dicyclohexylmethane diisocyanate, transcyclohexane-1,4-diisocyanate, hydrogenated m-xylene diisocyanate, and lysine diisocyanate, and trivalent or higher functional polyisocyanates can be also used.

A solution containing a polyamideimide precursor prepared by dissolving the derivative of the trivalent carboxylic acid compound having an acid anhydride group and the aromatic polyisocyanate in an organic polar solvent is coated on a substrate, and then the coated liquid is heated, so as to transform the polyamideimide precursor into polyamideimide. When the polyamideimide precursor is transformed into polyamideimide by the isocyanate method, carbon dioxide is generated to form polyamideimide without forming an intermediate product such as polyamic acid.

An example of formation of aromatic polyamideimide (polyamideimidization) by using trimellitic anhydride and aromatic diisocyanate is shown by the following formula (6):

(6)

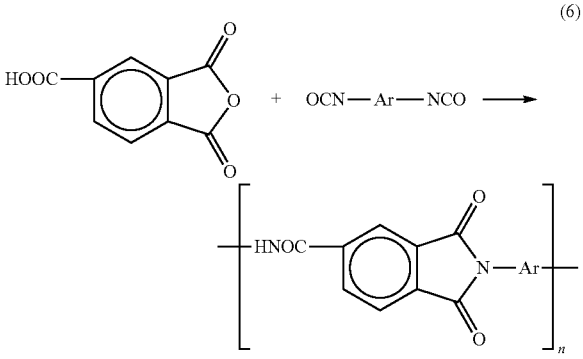

wherein Ar denotes an aromatic group.

γ-butyrolactone is preferably used as the organic polar solvent. Typically, the polyamideimide is more inexpensive than the polyimide, but likely to be influenced by temperature and humidity. Having comparatively a rigid structure, they have high strength but low flexibility, and are likely to cut and crack when bended. The former has a problem of image density and the latter has a problem of durability. γ-butyrolactone is effective for these problems.

As for solvents besides γ-butyrolactone, a residual solvent changes resistivity of the belt when the environment changes after a polyimide precursor is heated to be imidized, and the image density is likely to change. To solve these problems, the residual solvent needs to be nil, which further needs heating the belt for a long time at a high temperature of from 350 to 450° C. However, the belt is fragile and likely to break. When γ-butyrolactone is used alone and remains in the belt in an amount of from 5 to 5,000 ppm, the problem can be avoided. When less than 5 ppm, the belt is likely to break. When greater than 5.000 ppm, the image density is likely to change when the environment changes.

This may be because γ-butyrolactone forms a small hydrogen bond with an unreacted group when the polyimide is imidized, and the belt has suitable flexibility. Solubility of the acid anhydrides and diamine is higher in N-methyl-2-pyrrolidone than γ-butyrolactone, and they may be mixed for high solidification. However, only the γ-butyrolactone evaporates in imidization and is difficult to remain in the belt. Further, it is not preferable that they are mixed in terms of stability of the image quality and durability of the belt.

The polyamideimide is typically used alone, but can be combined with compatible polyamideimide or modified groups such as silicone and fluorine. Marketed polyamideimide varnish such as HPC-3010 from Hitachi Chemical Co. can be used.

To uniformly disperse carbon black in the intermediate transfer belt, it is preferable that carbon black is uniformly dispersed in γ-butyrolactone first, and that the mixture is fully mixed with the polyimide precursor.

Any dispersers such as ball mills, roll mills, beads mills and sand mills can be used in the present invention.

When a seamless belt is used as the intermediate transfer belt, carbon black is included in its layers such that the electric resistance thereof is $1\times10^{8}\Omega/\square$ to $1\times10^{15}\Omega/\square$ in the surface resistance when 500 V is applied thereto, and $1\times10^{8}$ Ω·cm to $1\times10^{14}$ Ω·cm in the volume resistance when 100 V is applied thereto. However, in terms of mechanical strength, carbon black is included in the layers in such an amount as they are not fragile and easily cracked. Namely, a coating liquid including the resin (a polyimide resin precursor or a polyamideimide resin precursor) and the electrical resistance regulator in suitable amounts, respectively is preferably used to prepare a seamless belt having a good balance between electrical properties (surface resistivity and volume resistivity) and mechanical strength.

When the electrical resistance is the carbon black, the content thereof is preferably from 10 to 25% by weight, and more preferably from 15 to 20% by weight. When the electrical resistance is the metal oxide, the content thereof is preferably from 1 to 50% by weight, more preferably from 10 to 30% by weight. When the content is too low, the resistance is difficult to have uniformity and largely varies relative to arbitrary potentials. When too much, the intermediate transfer belt deteriorates in mechanical strength for practical use.

The polyamideimide resin preferably has an average thickness of from 40 to 120 μm, and more preferably from 50 to 100 μm. When less than 40 μm, the edge of the belt is likely to cut when driven. When greater than 120 μm, the belt is likely to crack when driven.

The average thickness is an average value of the values of the thickness measured at arbitrarily selected 10 spots. The thickness can be measured by typical needle-indicating or eddy-current thickness meters, for example, by an electric micrometer manufactured by Anritsu Corporation.

The intermediate transfer belt is preferably an endless seamless belt in terms of recent multiple developing units and high-speed printing.

A method of preparing the intermediate transfer belt of the embodiment includes a process of forming a film on the outer surface of a cylindrical metal mold by coating a coating liquid including the polyamideimide precursor and at least γ-butyrolactone as an organic solvent thereon; a process of heating the film from the inside of the cylindrical metal mold to transform the polyamideimide precursor to a polyamideimide resin and having only the γ-butyrolactone remain in the polyamideimide resin in an amount of from 5 to 5,000 ppm; and a process of demolding the polyamideimide resin from the cylindrical metal mold.

A coating liquid including the polyamideimide precursor is coated on a cylindrical mold, such as a cylindrical metal mold, by a liquid applicator such as a nozzle and a dispenser, while slowly rotating the cylindrical mold, so as to uniformly coat the outer surface of the cylindrical mold with the coating liquid, to thereby perform flow casting (forming a coating film). Thereafter, the rotational speed is increased to a predetermined speed. Once the rotational speed reaches the predetermined speed, the rotational speed is maintained constant, and the rotation is continued for a predetermined period. Then, the temperature is gradually elevated while rotating the cylindrical mold, to thereby evaporate the solvent in the coating film at the temperature of 80 to 150° C. It is preferred that the vapor (e.g., the evaporated solvent) in the atmosphere be efficiently circulated and removed. Once a self-supporting film is formed, the mold with the film is placed in a heating furnace (baking furnace) capable of performing a high temperature treatment. Then, the temperature of the furnace is increased stepwise, and eventually a high temperature heat treatment (baking) is performed at the temperature ranging from about 200 to about 350° C., to thereby sufficiently amideimidize the polyamideimide precursor.

The intermediate transfer belt is preferably heated from the inside of the metal mold so as to include the γ-butyrolactone in an amount of from 5 to 5.000 ppm. Any heaters may be used, and specifically a halogen heater and an IH heater can be used. Coating the outer surface of the metal mold and heating from the inside thereof effectively control the intermediate transfer belt to include the γ-butyrolactone in an amount of from 5 to 5.000 ppm.

The method of preparing the intermediate transfer belt is not limited thereto, and appropriately selected depending on the intended purpose. Examples thereof include a method containing: preparing a coating liquid in which the aforementioned other components such as the electrical resistance-controlling agent are optionally dispersed in the polyamideimide precursor solution (polyamic acid solution); applying the coating liquid onto a substrate; and transforming (imdizing) polyamic acid, which is polyamideimide precursor, into polyamideimide, as well as forming the coating liquid into a layer by a processing, such as heating.

The substrate is not particularly limited and appropriately selected depending on the intended purpose, and examples thereof include a cylindrical metal mold. The polyamideimide precursor solution is coated on the outer or inner surface of the metal mold. The outer surface is preferably coated because it is easy to control the intermediate transfer belt to include the γ-butyrolactone in an amount of from 5 to 5,000 ppm.

As a method of measuring an amount of the γ-butyrolactone, a piece cut from tan arbitrary part of the intermediate transfer belt is analyzed by heat extraction gas chromatograph mass spectrometry (GC-MS). A marketed GC-MS device such as GCMS-QP2010 from Shimadzu Corp. can be used.

Third Embodiment

Figure 2:
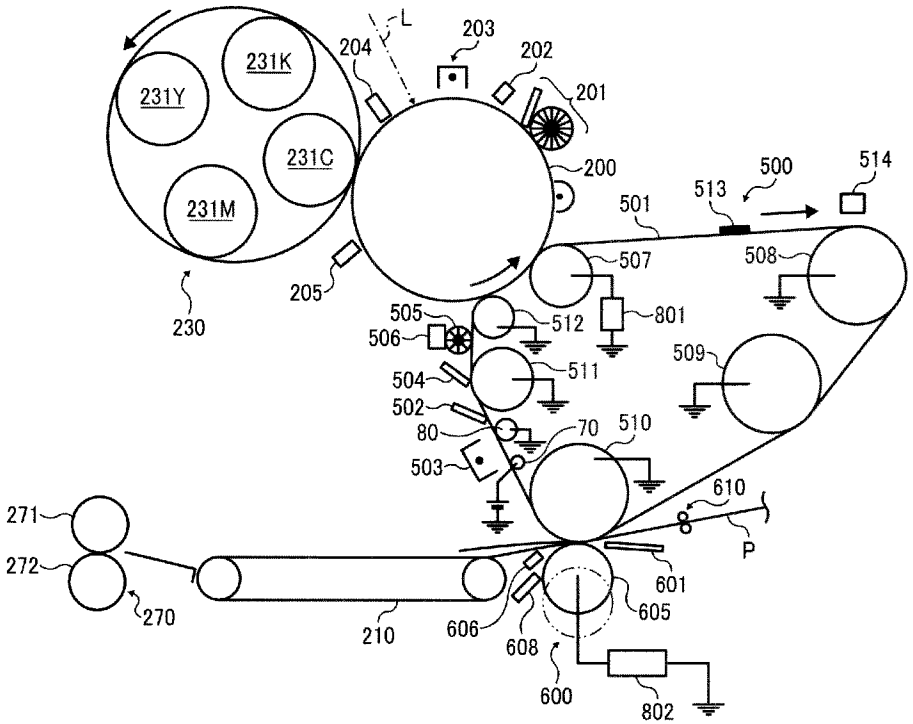
FIG. 2 is a schematic view illustrating an embodiment of a main part of the full-color image forming apparatus of the present invention.

Next, as a third embodiment, an image forming apparatus equipped with the intermediate transfer belt of the present invention is explained. FIG. 2 is a schematic view illustrating an embodiment of a main part of the full-color image forming apparatus of the present invention. The image forming apparatus includes an image bearer, an image developer developing a latent image formed on the image bearer with a toner to form a toner image thereon, an intermediate transfer belt the toner image is first transferred onto, and a transferer secondly transferring the toner image onto a recording medium from the intermediate transfer belt. The intermediate transfer belt is the first or the second embodiment thereof. The image forming apparatus is a digital color printer including one photoreceptor drum for forming four toner images having colors different from each other, i.e., black, yellow, magenta and cyan.

The seamless belt produced by the above-described method can be suitably used as an intermediate transfer belt mounted to a so-called intermediate transfer-based image forming apparatus, in which a plurality of color toner-developed images are sequentially formed on image bearing members, and then primarily transferred onto and sequentially superposed on an intermediate transfer belt, and the resultant primarily-transferred image is secondarily transferred onto a recording medium at one time, to thereby provide an electrophotographic apparatus (image forming apparatus) capable of forming high-quality images. Referring now to the schematic views of essential parts, detail description will next be given to a seamless belt used in the belt constitution section of an image forming apparatus of the present invention. Note that the schematic views are exemplary ones, which should not be construed as limiting the present invention thereto. FIG. 2 is a schematic view illustrating an embodiment of a main part of the image forming apparatus equipped with the intermediate transfer belt of the present invention.

As shown in FIG. 2, an intermediate transfer unit 500 including a belt member, includes an intermediate transfer belt 501 as an intermediate transfer medium stretched around a plurality of rollers. Around the intermediate transfer belt 501, a secondary transfer bias roller 605 serving as a secondary transfer charge applying unit of a secondary transfer unit 600, a belt cleaning blade 504 as a cleaning unit for the intermediate transfer medium, and a lubricant applying brush 505 as a lubricant applying member of a lubricant applying unit, etc. are disposed facing the intermediate transfer belt 501.

The intermediate transfer belt 501 is stretched around the primary transfer bias roller 507 serving as a primary transfer charge applying unit, the belt driving roller 508, a belt tension roller 509, a secondary transfer opposing roller 510, a cleaning opposing roller 511, and a feedback current detecting roller 512. Each roller is formed of a conductive material, and respective rollers other than the primary transfer bias roller 507 are grounded. A transfer bias is applied to the primary transfer bias roller 507, the transfer bias being controlled at a predetermined level of current or voltage according to the number of superimposed toner images by means of a primary transfer power source 801 controlled at a constant current or a constant voltage.

The intermediate transfer belt 501 is driven in the direction indicated by an arrow by the belt driving roller 508, which is driven to rotate in the direction indicated by an arrow by a driving motor (not shown). The intermediate transfer belt 501 serving as the belt member is generally semiconductive or insulative, and has a single layer or a multi layer structure. In the present invention, a seamless belt is preferably used, so as to improve durability and attain excellent image formation. Moreover, the intermediate transfer belt is larger than the maximum size capable of passing paper so as to superimpose toner images formed on a photoreceptor drum 200.

The secondary transfer bias roller 605 is a secondary transfer unit, which is configured to be brought into contact with a portion of the outer surface of the intermediate transfer belt 501, which is stretched around the secondary transfer opposing roller 510 by means of an attaching/detaching mechanism as an attaching/detaching unit described below. The secondary transfer bias roller 605 which is disposed so as to hold a transfer paper P with a portion of the intermediate transfer belt 501 which is stretched around the secondary transfer opposing roller 510, is applied with a transfer bias of a predetermined current by the secondary transfer power source 802 controlled at a constant current.

A pair of registration rollers 610 feeds the transfer paper P as a transfer medium at a predetermined timing in between the secondary transfer bias roller 605 and the intermediate transfer belt 501 stretched around the secondary transfer opposing roller 510. With the secondary transfer bias roller 605, a cleaning blade 608 as a cleaning unit is in contact. The cleaning blade 608 performs cleaning by removing deposition deposited on the surface of the secondary transfer bias roller 605.

In a color copying machine having the above-mentioned construction, when an image formation cycle is started, the photoreceptor drum 200 is rotated by a driving motor (not shown) in a counterclockwise direction indicated by an arrow, so as to form Bk (black), C (cyan), M (magenta), and Y (yellow) toner images on the photoreceptor drum 200. The intermediate transfer belt 501 is driven in the direction of the arrow by means of the belt driving roller 508. Along with the rotation of the intermediate transfer belt 501, a formed Bk-toner image, a formed C-toner image, a formed M-toner image, and a formed Y-toner image are primarily transferred by means of a transfer bias based on a voltage applied to the primary transfer bias roller 507. Finally, the images are superimposed on one another in order of Bk, C, M, and Y on the intermediate transfer belt 501, to thereby form a color image. For example, the Bk toner image is formed as follows.

In FIG. 2, a charger 203 uniformly charges a surface of the photoreceptor drum 200 to a predetermined potential with a negative charge by corona discharging. Subsequently, at a timing determined based on signals for detecting marks on the belt, by the use of an optical writing unit (not shown) raster exposure is performed based on a Bk color image signal. When the raster image is exposed, a charge proportional to an amount of light exposure is removed and a Bk latent electrostatic image is thereby formed, in an exposed portion of the photoreceptor drum 200 which has been uniformly charged. Then, by bringing a Bk toner charged to a negative polarity on the Bk developing roller of a Bk developing unit 231K into contact with the Bk latent electrostatic image, the Bk toner does not adhere to a portion where a charge remaining on the photoreceptor drum 200, and the Bk toner adsorbs to a portion where there is no charge on the photoreceptor drum 200, in other words a portion exposed to the raster light exposure, to thereby form a Bk toner image corresponding to the latent electrostatic image.

The Bk toner image formed on the photoreceptor drum 200 is primarily transferred to the outer surface of the intermediate transfer belt 501 being in contact with the photoreceptor drum 200, in which the intermediate transfer belt 501 and the photoreceptor drum 200 are driven at an equal speed. After primary transfer, slightly remaining toner which has not been transferred from the photoreceptor drum 200 to the intermediate transfer belt 501 is cleaned with a photoreceptor cleaning unit 201 in preparation for a next image forming operation on the photoreceptor drum 200. Next to the Bk image forming process, the operation of the photoreceptor drum 200 then proceeds to a C image forming process, in which C image data is read with a color scanner at a predetermined timing, and a C latent electrostatic image is formed on the photoreceptor drum 200 by a write operation with laser light based on the C image data.

A revolver development unit 230 is rotated after the rear edge of the Bk latent electrostatic image has passed and before the front edge of the C latent electrostatic image reaches, and the C developing unit 231C is set to a developing position, where the C latent electrostatic image is developed with C toner. From then on, development is continued over the area of the C latent electrostatic image, and at the point of time when the rear edge of the C latent electrostatic image has passed, the revolver development unit rotates in the same manner as the previous case of the Bk developing unit 231K to allow the M developing unit 231M to move to the developing position. This operation is also completed before the front edge of a Y latent electrostatic image reaches the developing position. As for M and Y image forming steps, the operations of scanning respective color image data, the formation of latent electrostatic images, and their development are the same as those of Bk and C, therefore, explanation of the steps is omitted.

Bk, C, M, and Y toner images sequentially formed on the photoreceptor drum 200 are sequentially registered in the same plane and primarily transferred onto the intermediate transfer belt 501. Accordingly, the toner image whose four colors at the maximum are superimposed on one another is formed on the intermediate transfer belt 501. The transfer paper P is fed from the paper feed section such as a transfer paper cassette or a manual feeder tray at the time when the image forming operation is started, and waits at the nip of the registration rollers 610. The registration rollers 610 are driven so that the front edge of the transfer paper P along a transfer paper guide plate 601 just meets the front edge of the toner image when the front edge of the toner image on the intermediate transfer belt 501 is about to reach a secondary transfer section where the nip is formed by the secondary transfer bias roller 605 and the intermediate transfer belt 501 stretched around the secondary transfer opposing roller 510, and registration is performed between the transfer paper P and the toner image.

When the transfer paper P passes through the secondary transfer section, the four-color superimposed toner image on the intermediate transfer belt 501 is collectively transferred (secondary transfer) onto the transfer paper P by transfer bias based on the voltage applied to the secondary transfer bias roller 605 by the secondary transfer power source 802. When the transfer paper P passes through a portion facing a transfer paper discharger 606 formed of charge eliminating spines and disposed downstream of the secondary transfer section in a moving direction of a transfer paper guiding plate 601, a charge on the transfer paper sheet is removed and then the transfer paper P is separated from the transfer paper guiding plate 601 to be delivered to a fixing unit 270 via the belt transfer unit 210 which is included in the belt constitution section (see FIG. 1). Furthermore, a toner image is then fused and fixed on the transfer paper P at a nip portion between fixing rollers 271 and 272 of the fixing unit 270, and the transfer paper P is then discharged outside of a main body of the apparatus by a discharging roller (not shown) and is stacked in a copy tray (not shown) with a front side up. The fixing unit 270 may have a belt constitution section.

On the other hand, the surface of the photoreceptor drum 200 after the toner images are transferred to the belt is cleaned by the photoreceptor cleaning unit 201, and is uniformly discharged by a discharge lamp 202. After the toner image is secondarily transferred to the transfer paper P, the toner remaining on the outer surface of the intermediate transfer belt 501 is cleaned by the belt cleaning blade 504. The belt cleaning blade 504 is configured to be brought into contact with the outer surface of the intermediate transfer belt 501 at a predetermined timing by the cleaning member attaching/detaching mechanism not shown in the figure.

On an upstream side from the belt cleaning blade 504 with respect to the rotating direction of the intermediate transfer belt 501, a toner sealing member 502 is provided so as to be brought into contact with the outer surface of the intermediate transfer belt 501. The toner sealing member 502 is configured to receive the toner particles scraped off with the belt cleaning blade 504 during cleaning of the remaining toner, so as to prevent the toner particles from being scattered on a conveyance path of the transfer paper P. The toner sealing member 502, together with the belt cleaning blade 504, is brought into contact with the outer surface of the intermediate transfer belt 501 by the cleaning member attaching/detaching mechanism.

To the outer surface of the intermediate transfer belt 501 from which the remaining toner has been removed, a lubricant 506 is applied by scraping it with a lubricant applying brush 505. The lubricant 506 is formed of zinc stearate, etc. in a solid form, and disposed to be brought into contact with the lubricant applying brush 505. The charge remaining on the outer surface of the intermediate transfer belt 501 is removed by discharge bias applied with a belt discharging brush (not shown), which is in contact with the outer surface of the intermediate transfer belt 501. The lubricant applying brush 505 and the belt discharging brush are respectively configured to be brought into contact with the outer surface of the intermediate transfer belt 501 at a predetermined timing by means of an attaching/detaching mechanism (not shown).

When the copying operation is repeated, in order to perform an operation of the color scanner and an image formation onto the photoreceptor drum 200, an operation proceeds to an image forming process of a first color (Bk) of a second sheet at a predetermined timing subsequent to an image forming process of the fourth color (Y) of the first sheet. As for the intermediate transfer belt 501, a Bk toner image of the second sheet is primarily transferred to the outer surface of the intermediate transfer belt 501 in an area of which has been cleaned by the belt cleaning blade 504 subsequent to a transfer process of the toner image of four colors on the first sheet of the transfer paper. Then, the same operations are performed for a next sheet as for the first sheet. Operations have been described in a copy mode in which full-color copies of four colors are obtained. The same operations are performed the number of corresponding times for specified colors in copy modes of three or two colors. In a monochrome-color copy mode, only the developing unit of a predetermined color in the revolver development unit 230 is put in a development active state until the copying operation is completed for the predetermined number of sheets, and the belt cleaning blade 504 is kept in contact with the intermediate transfer belt 501 while the copying operation is continuously performed.

Fourth Embodiment

Figure 3:
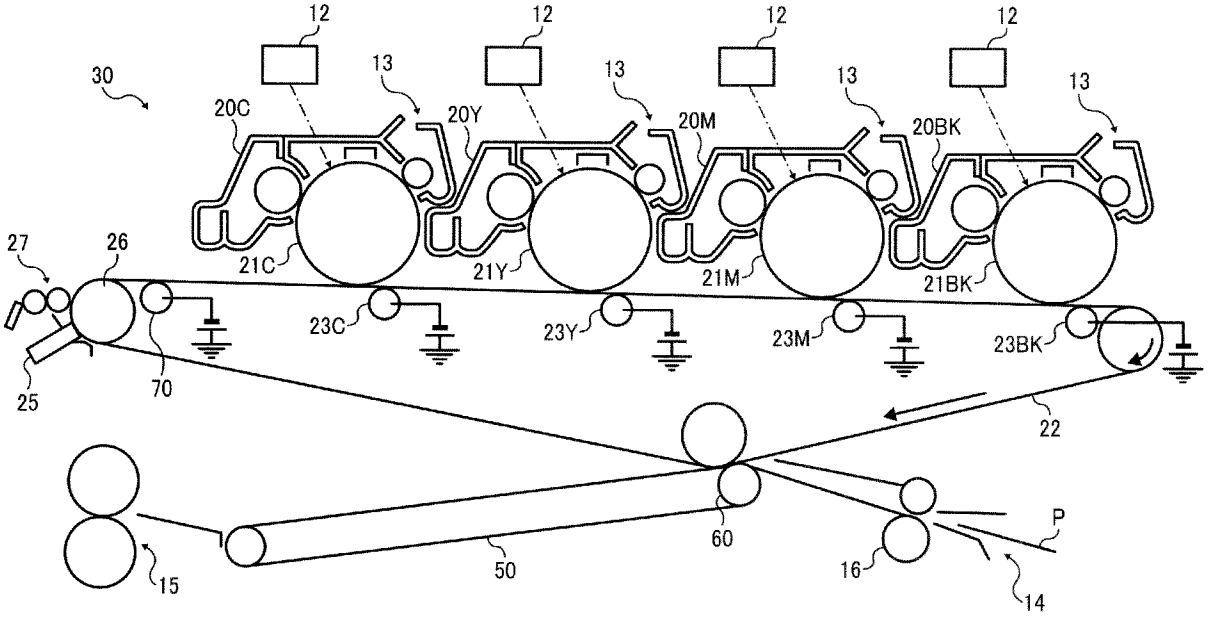
FIG. 3 is a schematic view illustrating another embodiment of a main part of the full-color image forming apparatus of the present invention.

A fourth embodiment of the image forming apparatus is explained. In the above-mentioned third embodiment, a copier having only one photoreceptor drum 200 is described. However, the electrophotographic intermediate transfer belt of the present invention can be used, for example, in a tandem type image forming apparatus, in which a plurality of photoreceptor drums are serially arranged along an intermediate transfer belt formed in the seamless belt. FIG. 3 is a schematic view illustrating another embodiment of a main part of the image forming apparatus of the present invention, in which plural photoreceptor drums are parallely located along an intermediate transfer belt formed of a seamless belt. The image forming apparatus includes an image bearer, an image developer developing a latent image formed on the image bearer with a toner to form a toner image thereon, an intermediate transfer belt the toner image is first transferred onto, and a transferer secondly transferring the toner image onto a recording medium from the intermediate transfer belt. The intermediate transfer belt is the first or the second embodiment thereof. The image forming apparatus is a four-drum digital color printer having four photoreceptor drums 21Bk, 21Y, 21M, and 21C for forming toner images of four colors (black, yellow, magenta and cyan).

In FIG. 3, a main body of a printer 30 is constituted with image writing sections 12, image forming sections 13, paper feeding sections 14, for electrophotographic color image formation. Based on image signals, image processing operation is performed in an image processing section, and converted to color signals of black (Bk), magenta (M), yellow (Y), and cyan (C), and then color signals are transmitted to the image writing sections 12. The image writing sections 12 are laser scanning optical systems each including a laser light source, a deflector such as a rotary polygon mirror, a scanning imaging optical system, and mirrors, and have four optical writing paths corresponding to color signals, and perform image writing corresponding to respective color signals on image bearing members (photoreceptors) 21Bk, 21M, 21Y, 21C provided for respective colors in the image forming sections 13.

The image forming sections 13 includes four photoreceptors 21Bk, 21M, 21Y and 21C serving as image bearing member for Black (Bk), magenta (M), yellow (Y) and cyan (C), respectively. Generally, organic photoreceptors are used as these photoreceptors. Around each of the photoreceptors 21Bk, 21M, 21Y, 21C, a charging unit, an exposure portion irradiated with laser beam from the image writing section 12, each of developing units 20Bk, 20M, 20Y, 20C, each of primary transfer bias rollers 23Bk, 23M, 23Y, 23C as a primary transfer unit, a cleaning unit (abbreviated), and other devices such as a discharging unit for the photoreceptor (not shown) are arranged. Each of the developing units 20Bk, 20M, 20Y, 20C uses a two component magnet brush developing method. An intermediate transfer belt 22, which is the belt constitution section, is located between each of the photoreceptors 21Bk, 21M, 21Y, 21C and each of the primary transfer bias rollers 23Bk, 23M, 23Y, 23C. Black (Bk), magenta (M), yellow (Y) and cyan (C) color toner images formed on the photoreceptors 21Bk, 21M, 21Y, 21C are sequentially superimposingly transferred to the intermediate transfer belt 22.

The transfer paper P fed from the paper feeding section 14 is fed via a registration roller 16 and then held by a transfer conveyance belt 50 as a belt constitution section. The toner images transferred onto the intermediate transfer belt 22 are secondarily transferred (collectively transferred) to the transfer paper P by a secondary transfer bias roller 60 as a secondary transfer unit at a point in which the intermediate transfer belt 22 is brought into contact with the transfer conveyance belt 50. Thus, a color image is formed on the transfer paper P. The transfer paper P on which the color image is formed is fed to a fixing unit 15 via the transfer conveyance belt 50, and the color image is fixed on the transfer paper P by the fixing unit 15, and then the transfer paper P is discharged from the main body of the printer.

Toner particles remaining on the surface of the intermediate transfer belt 22, which has not been transferred in the secondary transfer process, are removed by a belt cleaning member 25. On a downstream side from the belt cleaning member 25 with respect to the rotation direction of the intermediate transfer belt 22, a lubricant applying unit 27 is provided. The lubricant applying unit 27 includes a solid lubricant and a conductive brush configured to rub the intermediate transfer belt 22 so as to apply the solid lubricant to the surface of the intermediate transfer belt 22. The conductive brush is constantly in contact with the intermediate transfer belt 22, so as to apply the solid lubricant to the intermediate transfer belt 22. The solid lubricant is effective to improve the cleanability of the intermediate transfer belt 22, thereby preventing occurrence of filming thereon, and improving durability of the intermediate transfer belt 22.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

An amount of the γ-butyrolactone (GBL) or the other solvents in the intermediate transfer belt was determined by the following formula, using the method of analyzing a part randomly cut out from the belt by thermal extraction gas chromatograph mass analyzer GCMS-QP2010 from Shimadzu Corp.

Measured amount of the γ-butyrolactone or the other solvents (μg)/Weight of belt sample (g)<

Example 1

First, a polyimide resin was used as a material of the intermediate transfer belt. The intermediate transfer belt is a seamless belt.

Example 1-1

Preparation of Coating Liquid for Belt 1A 4-(2-phenylethyl)phthalic acid anhydride (PEPA) from Manac Inc., 3,3',4,4'-benzophenone tetracarboxylic acid anhydride (BTDA) from Daicel Chemical Industries, Ltd. and 3,4'-diaminodiphenylether (3,4'-DDE) from SEIKA CORP. were polymerized in a molar ratio of 0.5/0.5/1.0 in γ-butyrolactone and a nitrogen atmosphere at 130° C. to prepare a polyimide precursor solution 1A having a solid content of 15% and a viscosity of 10 Pa·s at 25° C. Next, a dispersion in which carbon black (Regal 400R from Cabot Corp.) was dispersed in γ-butyrolactone was mixed and stirred in the polyimide precursor solution 1A such that the carbon black is 18% by weight based on total weight of solid contents of polyamic acid to prepare a coating liquid for belt 1A.

[Preparation of Seamless Belt 1A]

The coating liquid 1A was uniformly coated by a dispenser on a blasted (roughened) outer surface of a metallic cylindrical mold having an outer diameter of 375 mm and a length of 340 mm while rotated at 50 rpm. After the polyimide coating liquid 1A was uniformly coated, the cylindrical mold was placed in a drier while rotated at 100 rpm. A halogen heater was placed in the center of the metal mold and the metal mold was gradually heated up to have a temperature of 110° C. for 60 min. Further, the metal mold was heated up to have a temperature of 200° C. for 20 min. Further, the metal mold was heated (burned) up to have a temperature of 320° C. for 60 min such that the coating liquid 1A was imidized. Then, the metal mold was gradually cooled and demolded to prepare a seamless belt 1A.

The seamless belt 1A had a thickness of 53 μm and included γ-butyrolactone in an amount of 26 ppm.

Example 1-2

The procedure for preparation of the seamless belt 1A in Example 1-1 was repeated except for changing the amount of the coating liquid 1A coated by the dispenser and the thickness of the seamless belt to prepare a seamless belt 1B having a thickness of 109 μm and including γ-butyrolactone in an amount of 188 ppm.

Example 1-3

The procedure for preparation of the seamless belt 1A in Example 1-1 was repeated except for changing the amount of the coating liquid 1A coated by the dispenser and the thickness of the seamless belt to prepare a seamless belt 1C having a thickness of 38 μm and including γ-butyrolactone in an amount of 6 ppm.

Example 1-4

The procedure for preparation of the seamless belt 1A in Example 1-1 was repeated except for changing the amount of the coating liquid 1A coated by the dispenser and the thickness of the seamless belt to prepare a seamless belt 1D having a thickness of 136 μm and including γ-butyrolactone in an amount of 345 ppm.

Example 1-5

The procedure for preparation of the seamless belt 1B in Example 1-2 was repeated except for heating the metal mold up to have a temperature of 300° C. for 30 min instead of 320° C. for 60 min to prepare a seamless belt 1E having a thickness of 114 μm and including γ-butyrolactone in an amount of 4,375 ppm.

Example 1-6

Preparation of Coating Liquid for Belt 1F

Pyromellitic acid anhydride (PMDA) from Mitsubishi Gas Chemical Co., Inc., 3,3',4,4'-benzophenone tetracarboxylic acid anhydride (BTDA) from Daicel Chemical Industries, Ltd., 3,4'-diaminodiphenylether (3,4'-DDE) from SEIKA CORP. and m-phenylenediamine (m-PDA) from NIPPON KAYAKU Co., Ltd. were polymerized in a molar ratio of 0.5/0.5/9.0/0.1 in γ-butyrolactone and a nitrogen atmosphere at 135° C. to prepare a polyimide precursor solution 1F having a solid content of 14% and a viscosity of 17 Pa·s at 25° C. Next, a dispersion in which carbon black (Regal 400R from Cabot Corp.) was dispersed in γ-butyrolactone was mixed and stirred in the polyimide precursor solution 1F such that the carbon black is 19.2% by weight based on total weight of solid contents of polyamic acid to prepare a coating liquid for belt 1F. Then, the procedure for preparation of the seamless belt 1A in Example 1-1 was repeated except for using the coating liquid 1F to prepare a seamless belt 1F having a thickness of 64 μm and including γ-butyrolactone in an amount of 15 ppm.

Example 1-7

Preparation of Coating Liquid for Belt 1G 4-(2-phenylethyl)phthalic acid anhydride (PEPA) from Manac Inc., 3,3',4,4'-biphenyltetracarboxylic acid anhydride (BPDA) from Ube Industries, Ltd. and 1,3-bis(aminophenoxy)benzene (TOE-R) from SEIKA CORP. were polymerized in a molar ratio of 0.5/0.5/1.0 in γ-butyrolactone and a nitrogen atmosphere at 130° C. to prepare a polyimide precursor solution 1G having a solid content of 15% and a viscosity of 15 Pa·s at 25° C. Next, a dispersion in which carbon black (MA100 from Mitsubishi Chemical Corp.) was dispersed in γ-butyrolactone was mixed and stirred in the polyimide precursor solution 1G such that the carbon black is 15.4% by weight based on total weight of solid contents of polyamic acid to prepare a coating liquid for belt 1F. Then, the procedure for preparation of the seamless belt 1A in Example 1-1 was repeated except for using the coating liquid 1G to prepare a seamless belt 1G having a thickness of 66 μm and including γ-butyrolactone in an amount of 87 ppm.

Example 1-8

The coating liquid 1A was uniformly coated on a mirrored inner surface treated with a release agent of a metallic cylindrical mold having an outer diameter of 375 mm and a length of 340 mm while rotated at 50 rpm.

After the coating liquid was uniformly coated, the cylindrical mold was placed in a drier generating and circulating hot air from outside of the metal mold while rotated at 100 rpm, and was gradually heated up to have a temperature of 110° C. for 60 min. Further, the metal mold was heated up to have a temperature of 200° C. for 20 min, and then the rotation thereof was stopped. Then, the cylindrical mold a film was formed on was gradually cooled and taken out from the drier. Further, the metal mold was heated (burned) up to have a temperature of 320° C. for 60 min. Then, the metal mold was gradually cooled and demolded to prepare a seamless belt 1H having a thickness of 61 μm and including γ-butyrolactone in an amount of 1,066 ppm.

In this Example 1-8, the metal mold was heated from the outside thereof after the outer surface thereof was coated with the coating liquid. In each of Examples 1-1 to 1-7, the metal mold was heated from the inside thereof to the contrary.

Comparative Example 1-1

Preparation of Coating Liquid for Belt 1I 3,3',4,4'-biphenyltetracarboxylic acid anhydride (BPDA) from Ube Industries, Ltd. and 3,4'-diaminodiphenylether (3,4'-DDE) from SEIKA CORP. were polymerized in a mixed solvent including γ-butyrolactone and N-methyl-2-pyrrolidone (NMP) in a weight ratio of 40/60 in a nitrogen atmosphere at 15° C. to prepare a polyimide precursor solution 11 having a solid content of 20% and a viscosity of 14 Pa·s at 25° C. Next, a dispersion in which carbon black (SPECIAL BLACK 4 from Evonik-Degussa GmbH) was dispersed in a mixed solvent including γ-butyrolactone and N-methyl-2-pyrrolidone in a weight ratio of 40/60 was mixed and stirred in the polyimide precursor solution 11 such that the carbon black is 16.7% by weight based on total weight of solid contents of polyamic acid to prepare a coating liquid for belt 1I.

[Preparation of Seamless Belt 1I]

The procedure for preparation of the seamless belt 1A in Example 1-1 was repeated except for using the coating liquid 1I to prepare a seamless belt 1I having a thickness of 58 μm and including γ-butyrolactone and N-methyl-2-pyrrolidone in amounts of 3 ppm and 166 ppm, respectively.

Comparative Example 1-2

The procedure for preparation of the seamless belt 1A in Example 1-1 was repeated except for heating the metal mold up to have a temperature of 340° C. for 30 min instead of 320°

C. for 60 min to prepare a seamless belt 1J having a thickness of 50 μm and including γ-butyrolactone in an amount of 3 ppm.

Comparative Example 1-3

The procedure for preparation of the seamless belt 1A in Example 1-1 was repeated except for changing the amount of the coating liquid 1A coated by the dispenser and the thickness of the seamless belt, and heating the metal mold up to have a temperature of 300° C. for 10 min instead of 320° C. for 60 min to prepare a seamless belt 1K having a thickness of 157 μm and including γ-butyrolactone in an amount of 5,778 ppm.

Comparative Example 1-4

The procedure for preparation of the seamless belt 1I in Comparative Example 1-1 was repeated except for replacing the N-methyl-2-pyrrolidone in the mixed solvent with N-dimethylformamide (DMF) to prepare a seamless belt 1L having a thickness of 53 μm and including γ-butyrolactone and N-dimethylformamide in amounts of 2 ppm and 187 ppm, respectively.

Comparative Example 1-5

The procedure for preparation of the seamless belt 1I in Comparative Example 1-1 was repeated except for replacing the N-methyl-2-pyrrolidone in the mixed solvent with N-dimethylacetoamide (DMAC) to prepare a seamless belt 1M having a thickness of 55 μm and including γ-butyrolactone and N-dimethylacetoamide in amounts of 3 ppm and 222 ppm, respectively.

<Image Stability Evaluation>

Each of the intermediate transfer belts 1A to 1L was installed in the image forming apparatus in FIG. 3. After the image forming apparatus was left in an environment of 25° C. and 50% RH (MM environment) for 24 hrs, 2 color (cyan and magenta) images were produced. Then, the image forming apparatus was left in an environment of 10° C. and 15% RH (LL environment) for 24 hrs, 1,000 two-color (cyan and magenta) images were produced. The image density of each one image in the MM environment and the LL environment was visually compared.

Excellent: No image deteriorated in density

Good: 1 to 5 images deteriorated in density

Fair: 5 to 10 images deteriorated in density

Poor: 11 or more images deteriorated in density

<Durability Evaluation>

To see durability of the belt, 400,000 images were produced in each of the MM environment and the LL environment. The evaluation was stopped when the belt was broken.

The results are shown in Tables 1-1 and 1-2.

TABLE 1-1

| | Belt | Thickness (μm) | GBL (ppm) | Other Solvent (ppm) |
|---|---|---|---|---|
| Example 1-1 | 1A | 53 | 26 | — |
| Example 1-2 | 1B | 109 | 188 | — |
| Example 1-3 | 1C | 38 | 6 | — |
| Example 1-4 | 1D | 136 | 345 | — |
| Example 1-5 | 1E | 114 | 4375 | — |
| Example 1-6 | 1F | 64 | 15 | — |
| Example 1-7 | 1G | 66 | 87 | — |
| Example 1-8 | 1H | 61 | 1066 | — |
| Comparative Example 1-1 | 1I | 58 | 3 | 166 (NMP) |
| Comparative Example 1-2 | 1J | 500 | 1 | — |
| Comparative Example 1-3 | 1K | 157 | 5778 | — |
| Comparative Example 1-4 | 1L | 53 | 2 | 187 (DMF) |
| Comparative Example 1-5 | 1M | 55 | 3 | 222 (DMAC) |

TABLE 1-2

| | Belt | Image Stability | Durability (MM) | Durability (LL) |
|---|---|---|---|---|
| Example 1-1 | 1A | Excellent | No break | No break |
| Example 1-2 | 1B | Excellent | No break | No break |
| Example 1-3 | 1C | Excellent | Broke (370,000) | Broke (370,000) |
| Example 1-4 | 1D | Excellent | Broke (310,000) | Broke (310,000) |
| Example 1-5 | 1E | Good | No break | No break |
| Example 1-6 | 1F | Excellent | No break | No break |
| Example 1-7 | 1G | Excellent | No break | No break |
| Example 1-8 | 1H | Good | No break | No break |
| Comparative Example 1-1 | 1I | Fair | No break | Broke (150,000) |
| Comparative Example 1-2 | 1J | Excellent | Broke (260,000) | Broke (260,000) |
| Comparative Example 1-3 | 1K | Poor | No break | No break |
| Comparative Example 1-4 | 1L | Fair | No break | Broke (110,000) |
| Comparative Example 1-5 | 1M | Fair | No break | Broke (120,000) |

Comparison between Examples 1-1 to 1-8 (the residual solvent was only γ-butyrolactone) and Comparative Examples 1-1, 1-4 and 1-5 (the residual solvents were γ-butyrolactone and N-methyl-2-pyrrolidone) proves that the image quality noticeably improves when the residual solvent is only γ-butyrolactone. Further, in the LL environment, the number of the images until the intermediate transfer belt broke increases.

Comparison between Examples 1-1 to 1-8 and Comparative Examples 1-2 and 1-3 proves that γ-butyrolactone remaining in the intermediate transfer belt in an amount of from 5 to 5,000 ppm noticeably improves the image quality and the number of the images until the intermediate transfer belt broke increases by from 19 to 42%.

Comparison between Examples 1-1, 1-2, 1-5, 1-6, 1-7 and 1-8 and Examples 1-3 and 1-4 proves that the intermediate transfer belt having a thickness of from 40 to 120 μm noticeably improves in durability in the LL environment.

Comparison between Examples 1-1 to 1-7 and 1-8 proves that the image stability in Example 1-8 in which the coating liquid was coated on the outer surface of the metal mold and heated from the inside thereof is better than that of each of Examples 1-1 to 1-7 in which the metal mold was heated from the outside thereof.

Thus, the intermediate transfer belt of the present invention produces high-quality images even in an environment of low temperature and low humidity, and has improved durability.

Example 2

Next, a polyamideimide resin was used as a material of the intermediate transfer belt. The intermediate transfer belt is a seamless belt.

Example 2-1

Preparation of Coating Liquid for Belt 2A

Trimellitic acid anhydride and 4,4'-fiphenylmethanediso-cyanate were reacted in a molar ratio of 1.0/1.0 in γ-butyrolactone and a nitrogen atmosphere at 150° C. for 5 hrs to prepare a polyamideimide precursor solution 2A having a solid content of 15% and a viscosity of 19 Pa·s at 25° C. Next, a dispersion in which carbon black (MA100 from Mitsubishi Chemical Corp.) was dispersed in γ-butyrolactone was mixed and stirred in the polyimide precursor solution 1A such that the carbon black is 22% by weight based on total weight of solid contents of polyamic acid to prepare a coating liquid for belt 2A.

[Preparation of Seamless Belt 2A]

The coating liquid 2A was uniformly coated by a dispenser on a blasted (roughened) outer surface of a metallic cylindrical mold having an outer diameter of 375 mm and a length of 340 mm while rotated at 50 rpm. After the polyimide coating liquid 1A was uniformly coated, the cylindrical mold was placed in a drier while rotated at 100 rpm. A halogen heater was placed in the center of the metal mold and the metal mold was gradually heated up to have a temperature of 110° C. for 60 min. Further, the metal mold was heated up to have a temperature of 200° C. for 20 min. Further, the metal mold was heated (burned) up to have a temperature of 260° C. for 60 min such that the coating liquid 2A was amideimidized. Then, the metal mold was gradually cooled and demolded to prepare a seamless belt 2A.

The seamless belt 2A had a thickness of 53 μm and included γ-butyrolactone in an amount of 88 ppm.

Example 2-2

The procedure for preparation of the seamless belt 2A in Example 2-1 was repeated except for changing the amount of the coating liquid 2A coated by the dispenser and the thickness of the seamless belt to prepare a seamless belt 2B having a thickness of 113 μm and including γ-butyrolactone in an amount of 390 ppm.

Example 2-3

The procedure for preparation of the seamless belt 2A in Example 2-1 was repeated except for changing the amount of the coating liquid 2A coated by the dispenser and the thickness of the seamless belt to prepare a seamless belt 2C having a thickness of 35 μm and including γ-butyrolactone in an amount of 9 ppm.

Example 2-4

The procedure for preparation of the seamless belt 2A in Example 2-1 was repeated except for changing the amount of the coating liquid 2A coated by the dispenser and the thickness of the seamless belt to prepare a seamless belt 2D having a thickness of 133 μm and including γ-butyrolactone in an amount of 667 ppm.

Example 2-5

The procedure for preparation of the seamless belt 2B in Example 2-2 was repeated except for heating the metal mold up to have a temperature of 240° C. for 30 min instead of 260° C. for 60 min to prepare a seamless belt 2E having a thickness of 117 μm and including γ-butyrolactone in an amount of 4,873 ppm.

Example 2-6

The coating liquid 2A was uniformly coated on a mirrored inner surface treated with a release agent of a metallic cylindrical mold having an outer diameter of 375 mm and a length of 340 mm while rotated at 50 rpm.

After the coating liquid was uniformly coated, the cylindrical mold was placed in a drier generating and circulating hot air from outside of the metal mold while rotated at 100 rpm, and was gradually heated up to have a temperature of 110° C. for 60 min. Further, the metal mold was heated up to have a temperature of 200° C. for 20 min, and then the rotation thereof was stopped. Then, the cylindrical mold a film was formed on was gradually cooled and taken out from the drier. Further, the metal mold was heated (burned) up to have a temperature of 260° C. for 60 min. Then, the metal mold was gradually cooled and demolded to prepare a seamless belt 2F having a thickness of 61 μm and including γ-butyrolactone in an amount of 1,517 ppm.

In this Example 2-6, the metal mold was heated from the outside thereof after the outer surface thereof was coated with the coating liquid. In each of Examples 2-1 to 2-5, the metal mold was heated from the inside thereof to the contrary.

Comparative Example 2-1

The procedure for preparation of the seamless belt 2A in Example 2-1 was repeated except for changing the solvent from only γ-butyrolactone to a mixed solvent including γ-butyrolactone and N-methyl-2-pyrrolidone at a weight ratio of 50/50 to prepare a seamless belt 2G having a thickness of 61 μm and including γ-butyrolactone and N-methyl-2-pyrrolidone in amounts of 4 ppm and 1,867 ppm, respectively.

Comparative Example 2-2

The procedure for preparation of the seamless belt 2G in Comparative Example 2-1 was repeated except for changing the mixed solvent including γ-butyrolactone and N-methyl-2-pyrrolidone at a weight ratio of 50/50 to a mixed solvent including γ-butyrolactone and N-dimethylformamide (DMF) at a weight ratio of 50150 to prepare a seamless belt 2H having a thickness of 59 μm and including γ-butyrolactone and N-methyl-2-pyrrolidone in amounts of 2 ppm and 130 ppm, respectively.

Comparative Example 2-3

The procedure for preparation of the seamless belt 2G in Comparative Example 2-1 was repeated except for changing the mixed solvent including γ-butyrolactone and N-methyl-2-pyrrolidone at a weight ratio of 50/50 to a mixed solvent including γ-butyrolactone and N-dimethylacetoamide (DMAC) at a weight ratio of 50/50 to prepare a seamless belt 2I having a thickness of 60 μm and including γ-butyrolactone and N-methyl-2-pyrrolidone in amounts of 3 ppm and 662 ppm, respectively.

Comparative Example 2-4

The procedure for preparation of the seamless belt 2E in Example 2-5 was repeated except for changing the amount of the coating liquid 2A coated by the dispenser and the thickness of the seamless belt to prepare a seamless belt 2J having a thickness of 153 μm and including γ-butyrolactone in an amount of 5,824 ppm.

Comparative Example 2-5

The procedure for preparation of the seamless belt 2A in Example 2-1 was repeated except for heating the metal mold up to have a temperature of 300° C. for 60 min instead of 260° C. for 60 min to prepare a seamless belt 2K having a thickness of 50 μm and including γ-butyrolactone in an amount of 3 ppm.

Comparative Example 2-6

The procedure for preparation of the polyamideimide precursor solution 2A was repeated except for replacing the γ-butyrolactone with the N-methyl-2-pyrrolidone to prepare a polyamideimide precursor solution 2L. Next, a dispersion in which carbon black (MA77 from Mitsubishi Chemical Corp.) was dispersed in γ-butyrolactone was mixed and stirred in the polyimide precursor solution 2L such that the carbon black is 23% by weight based on total weight of solid contents of polyamic acid to prepare a coating liquid for belt 2L. Then, the procedure for preparation of the seamless belt 2A was repeated except for using the coating liquid 2L to prepare a seamless belt 2L having a thickness of 66 μm and including N-methyl-2-pyrrolidone in an amount of 3,792 ppm.

<Image Stability Evaluation>

Each of the intermediate transfer belts 2A to 2L was installed in the image forming apparatus in FIG. 2. After the image forming apparatus was left in an environment of 25° C. and 50% RH (MM environment) for 24 hrs, 2 color (cyan and magenta) images were produced. Then, the image forming apparatus was left in an environment of 10° C. and 15% RH (LL environment) for 24 hrs, 1,000 two-color (cyan and magenta) images were produced. The image density of each one image in the MM environment and the LL environment was visually compared.

Excellent: No image deteriorated in density

Good: 1 to 5 images deteriorated in density

Fair: 5 to 10 images deteriorated in density

Poor: 11 or more images deteriorated in density

<Durability Evaluation>

To see durability of the belt, 100,000 images were produced in each of the MM environment and the LL environment. The evaluation was stopped when the belt was broken.

The results are shown in Tables 2-1 and 2-2.

TABLE 2-1

| | Belt | Thickness (μm) | GBL (ppm) | Other Solvent (ppm) |
|---|---|---|---|---|
| Example 2-1 | 2A | 53 | 88 | — |
| Example 2-2 | 2B | 113 | 390 | — |
| Example 2-3 | 2C | 35 | 9 | — |
| Example 2-4 | 2D | 133 | 667 | — |
| Example 2-5 | 2E | 117 | 4873 | — |
| Example 2-6 | 2F | 61 | 1517 | — |
| Comparative Example 2-1 | 2G | 61 | 4 | 1867 (NMP) |
| Comparative Example 2-2 | 2H | 59 | 2 | 130 (DMF) |
| Comparative Example 2-3 | 2I | 600 | 3 | 662 (DMAC) |
| Comparative Example 2-4 | 2J | 153 | 7024 | — |
| Comparative Example 2-5 | 2K | 50 | 3 | — |
| Comparative Example 2-6 | 2L | 66 | — | 3792 (NMP) |

TABLE 2-2

| | Belt | Image Stability | Durability (MM) | Durability (LL) |
|---|---|---|---|---|
| Example 2-1 | 2A | Excellent | No break | No break |
| Example 2-2 | 2B | Excellent | No break | No break |
| Example 2-3 | 2C | Excellent | Broke (90,000) | Broke (90,000) |
| Example 2-4 | 2D | Excellent | Broke (80,000) | Broke (80,000) |
| Example 2-5 | 2E | Good | No break | Broke (90,000) |
| Example 2-6 | 2F | Good | No break | No break |
| Comparative Example 2-1 | 2G | Poor | Broke (30,000) | Broke (10,000) |
| Comparative Example 2-2 | 2H | Fair | Broke (50,000) | Broke (40,000) |
| Comparative Example 2-3 | 2I | Fair | Broke (50,000) | Broke (30,000) |
| Comparative Example 2-4 | 2J | Fair | No break | No break |
| Comparative Example 2-5 | 2K | Excellent | Broke (60,000) | Broke (60,000) |
| Comparative Example 2-6 | 2L | Poor | Broke (10,000) | Broke (3,000) |

Comparison between Examples 2-1 to 2-6 (the residual solvent was only γ-butyrolactone) and Comparative Examples 2-1, 2-2, 2-3 and 2-6 (the residual solvents were γ-butyrolactone and N-methyl-2-pyrrolidone) proves that the image quality noticeably improves when the residual solvent is only γ-butyrolactone. The seamless belts including the mixed solvent as a residual solvent broke when 3,000 to 50,000 images were produced, but the seamless belts including only γ-butyrolactone broke when 80,000 to 90,000 images were produced even in the LL environment.

Comparison between Examples 2-1 to 2-6 and Comparative Examples 2-4 and 2-5 proves that γ-butyrolactone remaining in the intermediate transfer belt in an amount of from 5 to 5,000 ppm improves both of the image stability and the durability.

Comparison between Examples 2-1, 2-2, 2-5, 2-6, and Examples 2-3 and 2-4 proves that the intermediate transfer belt having a thickness of from 40 to 120 μm noticeably improves in durability in the LL environment.

Comparison between Examples 2-1 to 2-4 (the coating liquid was coated on the outer surface of the metal mold and heated from the inside thereof) and Example 2-6 (the metal mold was heated from the outside thereof) proves that Examples 2-1 to 2-4 is better than Example 2-6 in the image stability.

Thus, the intermediate transfer belt of the present invention produces high-quality images even in an environment of low temperature and low humidity, and has improved durability.

Having now fully described the invention, it will be apparent to one of ordinary skill in the art that many changes and modifications can be made thereto without departing from the spirit and scope of the invention as set forth therein.

What is claimed is:

1. An intermediate transfer belt used in an image forming apparatus, the image forming apparatus comprising an image bearer, an image developer configured to develop a latent image formed on the image bearer with a toner to form a toner image, the intermediate transfer belt onto which the toner image is first transferred from the image bearer, and a transferer configured to secondly transfer the toner image onto a recording medium from the intermediate transfer belt, the intermediate transfer belt comprising:

a polyimide resin or a polyamideimide resin including only γ-butyrolactone of from 5 to 5,000 ppm as a residual solvent, wherein the intermediate transfer belt comprises carbon black.

2. The intermediate transfer belt of claim 1, wherein the intermediate transfer belt has a thickness of from 40 to 120 μm.

3. An image forming apparatus, comprising:

an image bearer;

an image developer configured to develop a latent image formed on the image bearer with a toner to form a toner image;

an intermediate transfer belt the toner image is first transferred onto; and a transferer configured to secondly transfer the toner image onto a recording medium from the intermediate transfer belt, wherein the intermediate transfer belt is the intermediate transfer belt according to claim 1.

4. The image forming apparatus of claim 3, wherein the image forming apparatus is a full-color image forming apparatus comprising plural image bearers located in tandem, each comprising an image developer for each color.

5. A method of preparing intermediate transfer belt, comprising:

coating a coating solution comprising a polyimide or polyamideimide precursor and at least γ-butyrolactone as an organic solvent on the outer surface of a cylindrical metal mold to form a film comprising the polyimide or polyamideimide precursor thereon;

heating the film from the inside of the cylindrical metal mold to polyimidize the polyimide precursor to form a polyimide resin in which only the γ-butyrolactone remains as an organic solvent in an amount of from 5 to 5,000 ppm; and demolding the polyimide resin from the cylindrical metal mold, wherein the intermediate transfer belt comprises carbon black.

6. A method of preparing intermediate transfer belt, comprising:

coating a coating solution comprising a polyamideimide precursor and at least γ-butyrolactone as an organic solvent on the outer surface of a cylindrical metal mold to form a film comprising the polyamideimide precursor thereon;

heating the film from the inside of the cylindrical metal mold to polyamideimidize the polyamideimide precursor to form a polyimide resin in which only the γ-butyrolactone remains as an organic solvent in an amount of from 5 to 5,000 ppm; and demolding the polyimide resin from the cylindrical metal mold, wherein the intermediate transfer belt comprises carbon black.

* * * * *